United States Patent [19]

Dau et al.

[11] 4,331,453

[45] May 25, 1982

[54] ABRASIVE ARTICLE

[75] Inventors: Donald E. Dau; Leonard E. Nelson, both of St. Paul, Minn.

[73] Assignee: Minnesota Mining and Manufacturing Company, St. Paul, Minn.

[21] Appl. No.: 90,146

[22] Filed: Nov. 1, 1979

[51] Int. Cl.[3] ..... C09K 3/14

[52] U.S. Cl. ..... 51/298; 51/296; 51/400; 428/238

[58] Field of Search ..... 51/295, 296, 298, 400; 428/238

[56] References Cited

U.S. PATENT DOCUMENTS

| | | | |
|---|---|---|---|
| 2,958,593 | 11/1960 | Hoover et al. | 51/295 |
| 3,324,609 | 6/1967 | Stein et al. | 51/400 |
| 3,688,453 | 9/1972 | Legacy et al. | 51/400 |
| 3,862,522 | 1/1975 | Mednick | 51/295 |
| 3,926,585 | 12/1975 | Lukowski | 51/295 |
| 3,976,525 | 8/1976 | Mednick | 51/295 |
| 4,018,574 | 4/1977 | Dyer | 51/295 |
| 4,082,521 | 4/1978 | McGarvey | 51/295 |
| 4,133,144 | 1/1979 | Early et al. | 51/295 |

OTHER PUBLICATIONS

Saunders, J. H. & Frisch, K. C., Polyurethanes Chemistry and Technology, Part II, vol. XVI, 1964.

*Primary Examiner*—Donald E. Czaja
*Assistant Examiner*—W. Thompson
*Attorney, Agent, or Firm*—Cruzan Alexander; Donald M. Sell; Richard Francis

[57] ABSTRACT

Delamination-resistant abrasive belts and discs suitable for offhand and automated article finishing comprise a lofty, non-woven, three-dimensional abrasive web adhesively bonded to a stretch-resistant woven fabric with a polyurethane binder comprising the reaction product of poly-1,4 oxybutylene) glycol diisocyanate having a molecular weight of about 500–4000 and a reactive compound capable of reacting with the isocyanate radicals. The reactive compound is selected from a group consisting of water, diol, triol, diamine or mixtures thereof.

5 Claims, 3 Drawing Figures

ABRASIVE ARTICLE

BACKGROUND OF THE INVENTION

1. Field of the Invention

This invention relates to abrasive articles comprising a three-dimensional abrasive web adhesively bonded to a woven fabric with polyurethane binder.

2. Prior Art

Lofty, open, low-density, fibrous, non-woven three-dimensional abrasive belts and discs have been found useful in offhand and automated finishing of various articles of wood, brass, aluminum, steel, and the like. Such abrasive articles provide a long, continuous striking pattern and uniform finish without lapping or parting lines, without need for belt oscillation, and they are relatively non-loading and cool running.

Attempts to make commercially suitable lofty, open, low-density three-dimensional abrasive belts and discs having reasonable work life together with adequate abrasiveness have for the most part been disappointing. Unsupported or unreinforced belts and discs made from lofty, non-woven three-dimensional abrasive such as those disclosed in U.S. Pat. No. 2,958,593, while non-loading and cool running, stretch excessively and are not particularly sufficiently durable to provide an adequate work life. U.S. Pat. No. 3,324,609 describes an attempt to reinforce the web by needle tacking the three-dimensional abrasive web into a support web. U.S. Pat. No. 3,688,453 discloses another method of reinforcing three-dimensional web produced by needle tacking the web-forming fibers in a particular manner into a reinforcing scrim and then impregnating the resultant structure with binder containing abrasive. This product has met with some commercial success.

Attempts to make supported lofty, open belts by adhesively laminating the lofty, open, non-woven three-dimensional abrasive to support backings with conventional adhesives such as rubber:resin adhesive have been disappointing because the resultant laminate has generally had low resistance to snagging on articles being finished and it easily delaminates during use.

SUMMARY OF THE INVENTION

The present invention provides improved lofty, open, low-density, fibrous, non-woven three-dimensional abrasive belts and discs suitable for offhand and automated finishing of various articles of wood, brass, aluminum, steel and the like. The abrasive articles of the present invention provide a long, continuous striking pattern and uniform finish without lapping or parting lines, are relatively non-loading and cool running, and have a commercially reasonable work life together with adequate abrasiveness.

Articles according to the present invention comprise a lofty, open, low-density, fibrous, non-woven, three-dimensional abrasive layer which is adhesively bonded to a stretch-resistant woven fabric by a polyurethane binder. The polyurethane binder comprises the reaction product of poly(1,4-oxybutylene)glycol diisocyanate having a molecular weight of about 500–4000 and a reactive compound capable of reacting with the isocyanate groups of the diisocyanate compound. The reactive compound is selected from the group consisting of water, diol, triol, primary diamine and mixtures thereof. The abrasives so defined have excellent adhesion between the support backing and the abrasive layer and thus do not readily delaminate during use. Belts and discs wear evenly providing a uniform finish until the abrasive is exhausted.

DETAILED DESCRIPTION OF THE PREFERRED EMBODIMENT

Figure 1:
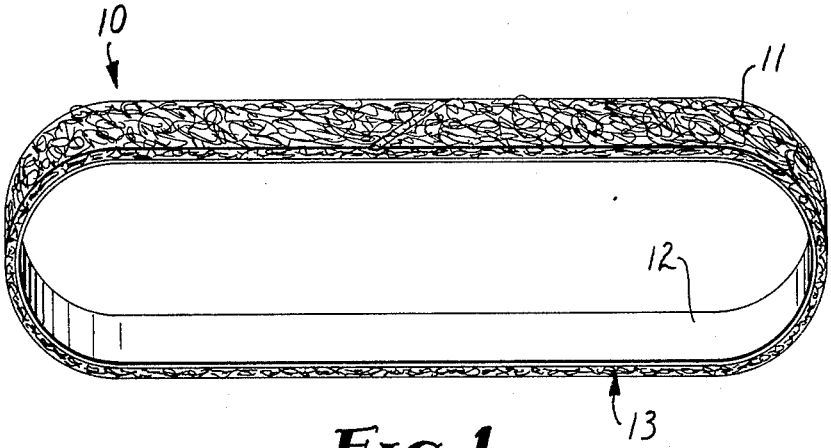
FIG. 1 is a perspective view of an abrasive belt in accordance with the present invention.
Figure 2:
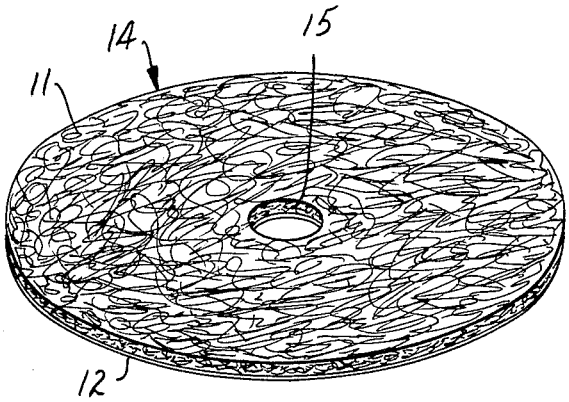
FIG. 2 is a perspective view of an abrasive disc in accordance with the present invention.
Figure 3:
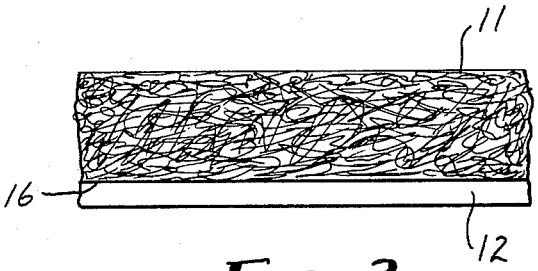
FIG. 3 is an enlarged side elevation view of the abrasive belt of FIG. 1.

Referring now to FIGS. 1 and 3, there is shown an abrasive article 10 as a laminate of a three-dimensional abrasive layer 11 adhesively bonded to a woven support backing 12 by polyurethane adhesive 16. The abrasive article may be in the form of an endless belt 13 (as depicted in FIG. 1) or in the form of a disc 14 (as depicted in FIG. 2) which may have a central opening 15 to facilitate mounting.

The lofty, open, low-density, fibrous, non-woven web portion of the three-dimensional abrasive layer 11 of article 10 may be of any synthetic fiber such as nylon, polyester, etc. capable of withstanding the temperatures at which the impregnating resins are cured without deterioration. The fibers are preferably tensilized and crimped. Fibers found satisfactory for the non-woven portion are about 0.75 to about 4 inches, preferably about 1.5 to about 2.5 inches, in length, and have a denier of about 1.5 to about 500, preferably 15 to 100. If desired, fibers of mixed denier may be used to obtain a desired scratch pattern. Also, use of larger fibers permits the use of larger abrasive particles. The non-woven web is readily formed on a "Rando Webber" machine (commercially available from Rando Machine Corporation) or may be formed by other conventional carding processes. The non-woven portion of the abrasive article preferably comprises at least about 25 (most preferably about 60) grains per 24 square inches of product surface area. Lesser amounts of fiber provides belts having a somewhat lower commercial work life. These fiber weights typically provide a web prior to integration having a thickness on the order of about 0.25 to about 3 inches, preferably about 1 inch. The web is integrated, e.g., by needle tacking, to obtain a higher degree of compaction than obtainable by the web forming machines or carding processes per se to reduce the tendency to snag in use. The integrated web thickness is typically on the order of 0.13 to 0.5 inch.

The amount or degree of needle tacking found necessary to provide useful abrasive articles has been found to be at least about 50, preferably at least about 125 needle penetrations per square inch of web when $15\times18\times25\times3.5$ RB needles (commercially available from the Torrington Company) are used. The needle tacking is readily accomplished by use of a conventional needle loom such as that commercially available from the James Hunter Machine Company.

Following needle tacking, the article is impregnated either with a resin-abrasive slurry or a resin binder using a 2-roll coater to thoroughly saturate the non-woven web. Preferred resins are those which are relatively hard and which provide firm bonding of the non-woven fibers to each other. Resins found satisfactory are those such as phenol-formaldehyde, epoxy, polyurethane, urea-formaldehyde, etc., and are the resins commonly utilized in making non-woven, low-density abrasives. Preferably, resin is applied by means of a 2-roll coater which simultaneously applies resin to both sides of the web to provide thorough impregnation. The top surface is coated with resin-abrasive slurry by spray coating. For mineral coating belts satisfactory for use in article finishing, it has been found that the non-woven surface of the belt should have a Shore A durometer of about 25 to 85 as measured with a 3/16 inch diameter instrument foot. A lower durometer provides a belt easily snagged and torn by sharp corners, etc. on the articles being finished. Articles of higher durometer are excessively dense, load up with pieces of abradant, perform like sandpaper, and do not provide the excellent uniform finish typically imparted by non-woven abrasives.

The abrasive particles utilized are those of 24 grade and finer normally used for a finishing operation and comprise those such as aluminum oxide, silicon carbide, talc, cerium oxide, garnet, flint, emery, etc. If desired, the commonly used metal working lubricants such as greases, oils, stearates, and the like may be incorporated into the three-dimensional abrasive layer of the belts or discs of the invention.

The woven supporting backing is a stretch-resistant fabric, i.e., one having a low stretch value when pulled in opposite directions, e.g., less than about 5%, preferably less than about 2.5%, when subjected to 100 pounds stress per lineal inch width. Preferred materials to provide the woven backing of the abrasive product of the present invention are conventional woven backing materials utilized in the preparation of coated abrasive products. Such woven backing materials include woven fabrics formed of synthetic or natural fibers such as nylon, polyester, or cotton, for example, drills or jeans fabric. Such fabrics are typically treated with a sizing agent, such treatment being preferred to produce the abrasive product of the present invention. The fabric should be selected so that it is compatible with the solvents, binders and processing conditions utilized in the preparation of the abrasive product of the present invention.

The polyurethane adhesive utilized to bind the non-woven web to the backing fabric comprises the reaction product of poly(1,4-oxybutylene)glycol diisocyanate having a molecular weight of about 500–4000 and a reactive compound having at least one active hydrogen atom capable of reacting with the isocyanate radicals of the diisocyanate to cause polymerization. The reactive compound is selected from the group consisting of water, diol, triol, diamine, or mixtures thereof. This adhesive binder produces a tough adherent bond between the woven fabric and the non-woven web which results in a tough snag-resistant abrasive disc or belt which is highly resistant to delamination in use.

The reactive compound preferably has at least two active hydrogen atoms capable of reacting with the isocyanate groups of the diisocyanate compound and is preferably selected from polyester to polyether diols having a molecular weight of about 50–3000, triols having a molecular weight of 75–1500, primary diamines, other such reactive compounds and mixtures thereof.

Representative classes of polyester polyols are made by condensation of a polycarboxylic acid or anhydride with a polyol. Representative polycarboxylic acids are the aliphatic dicarboxylic acids such as adipic, glutaric, suberic, sebacic and azelaic, and the aromatic acids such as phthalic, terephthalic and isophthalic and the corresponding tri and higher functionality carboxylic acids. Representative polyols are the glycols such as ethylene, propylene, butylene and higher, the triols such as glycerol, trimethylol propane and trimethylolethane and the tetrols such as pentaerythritol and the hexols.

The amounts of diisocyanate and reactive compound are preferably selected to provide a stoichiometric amount of each so that substantially all of the isocyanate groups are reacted, or to provide an excess of isocyanate compound which can then be reacted with water, either added or from the atmosphere. The reactive compound should be selected to provide, on mixing with the diisocyanate, a liquid composition which has an adequate liquid state to permit manufacture of the abrasive article, yet will cure thereafter in a commercially reasonable period of time to provide the finished product.

Other polyfunctional isocyanate compounds may be added in quantities up to 50 parts by weight per 100 parts total isocyanate compound to modify the binder somewhat. For example, isocyanate compounds having an isocyanate functionality greater than 2 may be added to produce a harder binder on curing. Such additive polyisocyanate compounds having a functionality greater than 2 also result in a shorter cure time.

The reactive compound may be a diol, triol, diamine, water or a mixture of two or more of these materials to provide modification in the adhesive binder. The addition of triol results in a more highly cross-linked binder which may be somewhat harder and likely will cure in a shorter period of time.

The abrasive articles according to the present invention may be conveniently prepared by forming the non-woven web using conventional web-forming equipment as described above, needle tacking the webs, applying liquid binder and abrasive granules, curing the binder to produce the three-dimensional abrasive layer, applying a coating of liquid laminating binder material to the surface of the woven fabric material employing conventional coating techniques such as roll coating, curtain coating, and the like, placing the web on the binder-coated surface of the woven backing, and permitting the binder to cure. The process steps are well known individually and equipment to carry out each of the steps is available and well known in the art.

The laminating polyurethane adhesive is self cured under ambient conditions without heat or the need for a catalyst, although heat (e.g., from about 70° F. to 150° F.) or a catalyst (e.g., triethylene diamine) may be employed separately or together to provide faster curing.

The following examples, in which all parts are by weight, unless otherwise indicated, further illustrate the abrasive articles of the invention.

EXAMPLE 1

An air laid needled non-woven web weighing 60 grains per 24 square inches was prepared essentially as described in Example 1 of assignee's U.S. Pat. No. 3,688,453 with the exception that no scrim cloth was used and only 2-inch 50 denier per filament oriented nylon 66 fibers were used. The needled non-woven backing was then roll coated with the following resin solution.

| Ingredients | Parts |
|---|---|
| Ketoxime-blocked poly(1,4-oxybutylene)glycol tolylene diisocyanate having a molecular weight of about 1500 | |

-continued

| Ingredients | Parts |
|---|---|
| (sold under the trade designation "Adiprene" BL-16) | 66.2 |
| Mixture of 35 parts p,p'-methylene dianiline (sufficient to provide 1 $NH_2$ group for each NCO group) and 65 parts ethylene glycol monoethyl ether acetate sold under the trade designation Cellosolve (acetate solvent) | 22.9 |
| Red pigment dispersion (contains about 10% pigments, about 20% Adiprene BL-16 and 70% ethylene glycol monoethyl ether acetate solvent) | 10.9 |
| Ethylene glycol monoethyl ether acetate solvent (solution viscosity was adjusted to 1,200–1,400 cps. by addition of glycol monoethyl ether acetate) | as required |

After coating, the adhesive coating was cured in an air impingement oven until dry and non-tacky (about 320° F. for 6 minutes). The dried article contained 70 grains of the adhesive composition per 24 square inches.

A final abrasive-adhesive slurry was spray-coated on the top surface of the web, dried at 250°–290° F. for 3 minutes and cured at 310°–320° F. for 10 minutes in an air impingement oven. The dry coating weight of the slurry was 225 grains per 24 square inches and the spray composition was:

| Ingredients | Parts |
|---|---|
| 2-ethoxyethanol solvent (available under the trade designation "Ethyl Cellosolve") | 8.4 |
| A-stage base-catalyzed phenol-formaldehyde resin having a phenol-formaldehyde mol ratio of 1:1.9 (70% solids) | 21.0 |
| A 100% solids amine terminated polyamide resin having a viscosity of about 700 cps, an acid number of about 3 and an amine value of about 320 grams of resin per amine equivalent (commercially available from the Celanese Coating Co. under the trade designation "Epi-Cure 852") | 4.8 |
| Fused alumina abrasive grains grade 100–150 (available under the trade designation "Alundum") | 59.4 |
| Red dye (13% solids in Ethyl Cellosolve) | 1.5 |
| Petroleum oil (632–712 S.S.U. seconds at 100° F. and 70–74 S.S.U. seconds at 210° F.) | 3.9 |
| Bentonite | 1.0 |

The solution viscosity was adjusted to 800 cps by addition of 2-ethoxyethanol (available under the trade designation "Ethyl Cellosolve")

The resultant dried web was adhesively laminated to a water-proofed (with an epoxy-polyamine resin) cotton drills cloth similar to that used to make a water-proof coated abrasive belt. After combining and mixing Parts A and B of the following 100% solids laminate adhesive, it was knife-coated on the "coat"-side of drills cloth backing.

| Ingredients | Parts |
|---|---|
| Part A | |
| Poly(1,4-oxybutylene)glycol diisocyanate having a molecular weight of about 1330 (sold under the trade designation "Adiprene" L-167) | 80.84 |
| Polymethylene polyphenyl isocyanate having an equivalent weight of about 130 (available as "Mondur MRS" from the Mobay Chemical Company | 10.96 |
| Part B | |
| 1,4-Butanediol | 6.29 |
| Trimethylol propane | 1.80 |
| Triethylene diamine, 33% active | .11 |

The adhesive coating weight was 55 grams per 24 square inches and the backing weighed 96 grains per 24 square inches. The adhesive coated surface of the cloth was brought in contact with the bottom side of the abrasive coated, needled non-woven web and wound with the non-woven abrasive material out onto a 10-inch diameter core using a pack roller to compress the composite about 35%. While the pack roller was still in contact with the roll of material, typically 50 yards long, the outside of the roll was secured with "Scotch" Brand No. 898 filament tape to keep the drum of material compressed and the adhesive coated cloth and non-woven abrasive in intimate contact.

The secured drum of material was allowed to set at room temperature (70° F.) for 4–6 days to permit the laminating adhesive to cure. The resultant laminate was slit to the desired width and fabricated into endless belts using conventional coated abrasive belt manufacturing methods and adhesives.

The force required to delaminate the cloth backing from the non-woven abrasive face was determined by cutting a 2-inch by 7-inch sample in the machine direction of the laminate. This sample, after starting a separation between the non-woven layer and the cloth backing for about 1-inch by cutting, was placed in the jaws of an Instron tensile tester. The jaws were separated at the rate of 5-inches per minute and the average force required to separate was recorded. The laminate of this example required 15.5 lbs. force per inch of sample width to separate, with a range of 10–25 lbs.

The laminate was further tested in a flex tester to measure resistance to delamination. In this test, a strip ($\frac{1}{2}''\times 25''$) of the laminate was flexed by passing the non-woven surface of the laminate over and in contact with the first roll of a movable 2 roll set of parallel $1\frac{1}{4}$-inch diameter steel rollers spaced from each other with their ends in registry with the center of the first roll positioned 1-inch above the horizontal plane defined by the center of the other roll and the rolls spaced center to center 2-inches apart. The laminate, fixed on one end, was deployed adjacent its fixed end first in a horizontal position over and in contact (about 190°) with the first or upper roll, then in an S-shaped path around the lower roll, and again in a horizontal position and finally over a third roller (held in fixed position with respect to the 2 roll set), with the other end of the laminate being weighted with 8.8 lbs. load to cause that portion of the laminate extending over the third roller to hang vertically. The two rollers were attached to a common support which traversed horizontally back and forth 6-inches with each back and forth traverse equaling one cycle. The rollers moved back and forth at the rate of 104 cycles per minute. A commercially useful product will have a life of at least 25,000 cycles, preferably at least 50,000 cycles in this test. The laminate of this example did not show any delamination after 100,000 cycles in this test.

EXAMPLE 2

| Ingredients | Parts |
|---|---|
| Ketoxime-blocked poly(1,4-oxybutylene)glycol tolylene diisocyanate having a molecular weight of about 1500 (sold under the trade designation "Adiprene" BL-16) | 48.7 |
| Poly-(1,4-oxybutylene)glycol diisocyanate having a molecular weight of about 2050 (sold under the trade designation "Adiprene" L-100) | 34.8 |
| Mixture of 35 parts p,p'-methylene dianiline and 65 parts ethylene glycol monoethyl ether acetate | 22.5 |

The cloth and the non-woven abrasive were wound on the core to compress the composite about 35%. The drum of material was secured to retain the material under compression. Hot air was forced into one side of the drum and out the other side of the drum. The adhesive was cured with hot air at 150° F. for 1 hour and 220° F. for 16 hours.

The laminate of this example were tested in the flex test failed at a maximum 105,000 cycles with rupture of the backing and had an average of 58,000 cycles with both delamination and rupture of backing.

The resultant laminate was formed into a 3-inch×90-inch long endless belt and tested on a Hammond lathe backstand fitted with a 14-inch diameter, 3-inch wide, 30 durometer, smooth rubber contact roll. An 8-inch diameter, 3-inch wide steel idler wheel was forced with 70 lbs. force against the non-woven abrasive belt mounted on the contact wheel to cause some flexing of the belt in contact with the rubber contact roll. The contact wheel was rotated at 1250 RPM. The belt made from the laminate of this example was tested for 945 minutes and showed no delamination.

CONTROL EXAMPLE

As a control, instead of the two part laminate adhesive of Example 1, a 32% solids nitrile rubber resin adhesive (available from the 3M Company under the trade designation "EC 1099") was used. A 15 dry grains per 24 square inch coating of the adhesive was first knife coated on the backing and force dried in a 100° F. oven for 6 minutes. A second coat of the adhesive was knife coated over the first coat and the bottom side of the non-woven abrasive web of Example 1 was forced in contact with the wet adhesively coated backing by passing through two 10-inch diameter steel rolls spaced 120 mils apart. Room temperature air was forced through the non-woven web surface. The web was then passed through two 10-inch steel rolls forced together with 5 lbs force per linear inch of width. The laminate was then passed through a 100° F. oven for 15 minutes. The resultant laminate was wound on a jumbo and allowed to stand 3 days before testing. The total adhesive dry coating weight was 43 grains per 24 square inches.

The laminate of this example was tested for delamination under flex as described in Example 1. Delamination of greater than ¼-inch along the length of the strip and across the width of the strip was observed at 20,900 cycles maximum with most samples failing after 5,000–8,000 cycles. In the endless belt test as described in Example 2, the laminate of this example showed significant delamination along one or both edges after 260 minutes maximum with most belts showing delamination after 40–80 minutes. The force required to delaminate the non-woven abrasive web from the cloth backing as measured on the Instron tester as described in Example 1 was 9–14.5 lbs. per inch of width.

EXAMPLE 3

A laminate was made as in Example 1 except the following 100% solids adhesive was used:

| Ingredients | Parts |
|---|---|
| Poly-(1,4-oxybutylene)glycol diisocyanate having a molecular weight of about 1330 (sold under the trade designation "Adiprene" L-167) | 94.10 |
| 1,4-Butanediol | 4.55 |
| Trimethylol Propane | 1.30 |
| Triethylene diamine, 33% active | 0.05 |

The adhesive coating on the cloth backing weighed 50 grams per square inch. The resultant laminate was wound on a jumbo and allowed to set at room temperature (70° F.) for 4–6 days to permit the laminating adhesive to cure.

Two samples from the laminate of this example, when tested on the flex tester, ran 100,000 cycles without failure.

What is claimed is:

1. An abrasive article especially suited for offhand and automated article finishing having a lofty, non-woven, three-dimensional abrasive layer adhesively bonded to a stretch-resistant woven fabric, wherein the improvement comprises utilizing as said adhesive binder a polyurethane binder comprising the reaction product of poly(1,4-oxybutylene)glycol diisocyanate having a molecular weight of about 500 to 4000 and a reactive compound having at least one active hydrogen atom capable of reacting with the isocyanate groups wherein said reactive compound is selected from the group consisting of water, diol, triol, primary diamine and mixtures thereof.

2. The abrasive article of claim 1 wherein there is also included polyfunctional isocyanate such that the amount of polyfunctional isocyanate is up to about 50 parts by weight per 100 parts total polyfunctional isocyanate plus said poly(1,4-oxybutylene)glycol diisocyanate.

3. The abrasive article of claim 1 wherein said diol is a polyester or polyether diol having a molecular weight of about 50 to 3000.

4. The abrasive article of claim 1 wherein said triol has a molecular weight of about 75 to 1500.

5. The abrasive article of claim 1 wherein said binder comprises the reaction product of poly(1,4-oxybutylene)glycol diisocyanate, polymethylene polyphenyl isocyanate, 1,4-butanediol and trimethylol propane.

* * * * *

UNITED STATES PATENT AND TRADEMARK OFFICE

CERTIFICATE OF CORRECTION

PATENT NO. : 4,331,453

DATED : May 25, 1982

INVENTOR(S) : Donald E. Dau and Leonard E. Nelson

It is certified that error appears in the above—identified patent and that said Letters Patent is hereby corrected as shown below:

In the Title Page:

[75] "St. Paul" should read --Lake Elmo--.

Col. 3, line 7, "coating" should read --coated--.

Col. 3, line 59, "polyester to polyether" should read --polyester or polyether--.

Signed and Sealed this

Tenth Day of August 1982

[SEAL]

Attest:

GERALD J. MOSSINGHOFF

Attesting Officer

Commissioner of Patents and Trademarks